US009156130B2

(12) United States Patent
Shimano et al.

(10) Patent No.: US 9,156,130 B2
(45) Date of Patent: Oct. 13, 2015

(54) METHOD OF ADJUSTING PROFILE OF A POLISHING MEMBER USED IN A POLISHING APPARATUS, AND POLISHING APPARATUS

(71) Applicant: EBARA CORPORATION, Tokyo (JP)

(72) Inventors: Takahiro Shimano, Tokyo (JP); Mutsumi Tanikawa, Tokyo (JP); Hisanori Matsuo, Tokyo (JP); Kuniaki Yamaguchi, Tokyo (JP); Katsuhide Watanabe, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/187,150

(22) Filed: Feb. 21, 2014

(65) Prior Publication Data

US 2014/0287653 A1 Sep. 25, 2014

(30) Foreign Application Priority Data

Feb. 25, 2013 (JP) ..... 2013-034419

(51) Int. Cl.
*B24B 53/017* (2012.01)
*B24B 37/005* (2012.01)

(52) U.S. Cl.
CPC ..... *B24B 53/017* (2013.01); *B24B 37/005* (2013.01)

(58) Field of Classification Search
CPC ..... B24B 53/07; B24B 53/12; B24B 37/04; B24B 57/02; B24B 37/042
USPC ..... 451/5, 6, 11, 21, 41, 56, 72, 443
See application file for complete search history.

(56) References Cited

U.S. PATENT DOCUMENTS

| | | | | |
|---|---|---|---|---|
| 5,974,679 | A | 11/1999 | Birang et al. | |
| 6,113,462 | A * | 9/2000 | Yang | 451/5 |
| 6,364,752 | B1 * | 4/2002 | Kimura et al. | 451/56 |
| 6,495,463 | B2 * | 12/2002 | Halley | 438/690 |
| 6,835,116 | B2 * | 12/2004 | Oguri et al. | 451/8 |
| 7,070,479 | B2 * | 7/2006 | Faustmann et al. | 451/21 |
| 7,413,986 | B2 * | 8/2008 | Paik | 438/690 |
| 7,899,571 | B2 * | 3/2011 | Basim et al. | 700/121 |
| 8,221,193 | B2 * | 7/2012 | Chang et al. | 451/6 |
| 8,292,691 | B2 * | 10/2012 | Xu et al. | 451/5 |
| 2002/0164932 | A1 * | 11/2002 | Kamimura et al. | 451/56 |
| 2006/0196283 | A1 * | 9/2006 | Yang et al. | 73/865.9 |

(Continued)

FOREIGN PATENT DOCUMENTS

| | | |
|---|---|---|
| JP | 2010-076049 | 4/2010 |
| JP | 2011-143489 | 7/2011 |
| JP | 2012-009692 | 1/2012 |

OTHER PUBLICATIONS

Chen et al, "Operational Aspects of Chemical Mechanical Polishing Polish Pad Profile Optimization", Journal of the Electrochemical Society, 2000, 147(10), 3922-3930.

*Primary Examiner* — George Nguyen
(74) *Attorney, Agent, or Firm* — Baker & Hostetler LLP

(57) ABSTRACT

The method includes the steps of measuring a surface height of a polishing member 10 at each of plural oscillation sections Z1 to Z5 which are defined in advance on the polishing member 10 along an oscillation direction of a dresser 5; calculating a difference between a current profile obtained from measured values of the surface height and a target profile of the polishing member 10; and correcting moving speeds of the dresser 5 in the plural oscillation sections Z1 to Z5 so as to eliminate the difference.

20 Claims, 7 Drawing Sheets

(56) References Cited

U.S. PATENT DOCUMENTS

2010/0081361 A1 4/2010 Fukuda et al.
2011/0256812 A1 10/2011 Dhandapani et al.
2012/0270477 A1 10/2012 Nangoy et al.
2012/0315829 A1* 12/2012 Tanikawa et al. ..... 451/56

* cited by examiner

METHOD OF ADJUSTING PROFILE OF A POLISHING MEMBER USED IN A POLISHING APPARATUS, AND POLISHING APPARATUS

CROSS REFERENCE TO RELATED APPLICATION

This document claims priority to Japanese Patent Application No. 2013-034419 filed Feb. 25, 2013, the entire contents of which are hereby incorporated by reference.

BACKGROUND OF THE INVENTION

1. Field of the Invention

The present invention relates to a method of adjusting a profile of a polishing member used in a polishing apparatus for polishing a substrate, such as a wafer.

The present invention further relates to a polishing apparatus for polishing a substrate.

2. Description of the Related Art

As a more highly integrated structure of a semiconductor device has recently been developed, interconnects of a circuit become finer and dimensions of the integrated device decrease. Thus, it becomes necessary to polish a wafer having films (e.g., metal film) on its surface to planarize the surface of the wafer. One example of the planarization technique is a polishing process performed by a chemical-mechanical polishing (CMP) apparatus. This chemical-mechanical polishing apparatus includes a polishing member (e.g., a polishing cloth or polishing pad) and a holder (e.g., a top ring, a polishing head, or a chuck) for holding a workpiece, such as a wafer, to be polished. The polishing apparatus of this type is operable to press a surface (to be polished) of the workpiece against a surface of the polishing member and cause relative movement between the polishing member and the workpiece while supplying a polishing liquid (e.g., an abrasive liquid, a chemical liquid, slurry, pure water) between the polishing member and the workpiece to thereby polish the surface of the workpiece to a flat finish. Such a polishing process performed by the chemical-mechanical polishing apparatus yields a good polishing result due to a chemical polishing action and a mechanical polishing action.

Foam resin or nonwoven cloth is typically used as a material of the polishing member used in such chemical-mechanical polishing apparatus. Fine irregularities (or asperity) are formed on the surface of the polishing member and these fine irregularities serve as chip pockets that can effectively prevent clogging and can reduce polishing resistance. However, continuous polishing operations for the workpieces with use of the polishing member can crush the fine irregularities on the surface of the polishing member, thus causing a lowered polishing rate. Thus, a dresser, having a number of abrasive grains, such as diamond particles, electrodeposited thereon, is used to dress (condition) the surface of the polishing member to regenerate fine irregularities on the surface of the polishing member.

Examples of the method of dressing the polishing member include a method using a dresser (a large-diameter dresser) that is equal to or larger than a polishing area used in polishing of the workpiece with the polishing member and a method using a dresser (a small-diameter dresser) that is smaller than the polishing area used in polishing of the workpiece with the polishing member. In the method of using the large-diameter dresser, a dressing operation is performed, for example, by pressing a dressing surface, on which the abrasive grains are electrodeposited, against the rotating polishing member, while rotating the dresser in a fixed position. In the method of using the small-diameter dresser, a dressing operation is performed, for example, by pressing a dressing surface against the rotating polishing member, while moving the rotating dresser (e.g., reciprocation or oscillation in an arc or linearly). In both methods in which the polishing member is rotated during dressing, the polishing area on the surface of the polishing member for use in the actual polishing is an annular area centered on a rotational axis of the polishing member.

During dressing of the polishing member, the surface of the polishing member is scraped away in a slight amount. Therefore, if dressing is not performed appropriately, unwanted undulation is formed on the surface of the polishing member, causing a variation in a polishing rate within the polished surface of the workpiece. Such a variation in the polishing rate can be a possible cause of polishing failure. Therefore, it is necessary to perform dressing of the polishing member in a manner as not to generate the undesired undulation on the surface of the polishing member. One approach to avoid the variation in the polishing rate is to perform the dressing operation under appropriate dressing conditions including an appropriate rotational speed of the polishing member, an appropriate rotational speed of the dresser, an appropriate dressing load, and an appropriate moving speed of the dresser (in the case of using the small-diameter dresser).

SUMMARY OF THE INVENTION

Japanese laid-open patent publication No. 2010-76049 discloses that a surface of a polishing member is uniformly polished by oscillating a dresser at speeds which are set in advance in each of oscillation sections of the dresser. However, in the conventional dressing method, an intended profile of the polishing member may not be obtained.

The present invention has been made in order to solve the above issues. It is therefore an object of the present invention to provide a method of adjusting a profile of a polishing member which can achieve a target profile of a polishing member.

Further, it is an object of the present invention to provide a polishing apparatus which can perform such a method of adjusting the profile of the polishing member.

In order to achieve the above-described object, one aspect of the present invention provides a method of adjusting a profile of a polishing member used in a polishing apparatus for a substrate, the method including: dressing the polishing member by oscillating a dresser on the polishing member; measuring a surface height of the polishing member at each of plural oscillation sections which are defined in advance on the polishing member along an oscillation direction of the dresser; calculating a difference between a current profile obtained from measured values of the surface height and a target profile of the polishing member; and correcting moving speeds of the dresser in the plural oscillation sections so as to eliminate the difference.

In a preferred aspect of the present invention, calculating the difference between the current profile and the target profile comprises: calculating cutting rates of the polishing member in the plural oscillation sections from the measured values of the surface height; and calculating differences between the calculated cutting rates and target cutting rates which are set in advance respectively for the plural oscillation sections.

In a preferred aspect of the present invention, correcting the moving speeds of the dresser comprises correcting the moving speeds of the dresser on the polishing member in the plural oscillation sections in accordance with the differences between the calculated cutting rates and the target cutting rates.

In a preferred aspect of the present invention, calculating the differences between the calculated cutting rates and the target cutting rates comprises calculating cutting rate ratios which are ratios of the calculated cutting rates to the target cutting rates, and correcting the moving speeds of the dresser comprises multiplying the moving speeds of the dresser on the polishing member in the plural oscillation sections by the cutting rate ratios, respectively.

In a preferred aspect of the present invention, the method further includes: calculating a dressing time of the polishing member after the correction of the moving speeds of the dresser; and multiplying the corrected moving speeds by an adjustment coefficient for eliminating a difference between the dressing time after the correction and a dressing time of the polishing member before the correction of the moving speeds of the dresser.

In a preferred aspect of the present invention, the adjustment coefficient is a ratio of the dressing time after the correction to the dressing time before the correction.

In a preferred aspect of the present invention, the method further includes: measuring a film thickness of the substrate polished by the polishing member; and further correcting the corrected moving speeds based on a difference between a residual film thickness profile obtained from measured values of the film thickness and a target film thickness profile.

In a preferred aspect of the present invention, further correcting the corrected moving speeds comprises: calculating polishing rates of the substrate in plural zones arrayed in a radial direction of the substrate from the measured values of the film thickness; preparing target polishing rates which are set in advance for the plural zones; calculating cutting rates of the polishing member in the oscillation sections corresponding to the plural zones; calculating correction coefficients from the polishing rates, the target polishing rates, and the cutting rates; and multiplying the corrected moving speeds in the oscillation sections by the correction coefficients, respectively.

In a preferred aspect of the present invention, the method further includes: obtaining an initial film thickness profile and a target film thickness profile of the substrate; calculating a distribution of target amount of polishing from a difference between the initial film thickness profile and the target film thickness profile; and further correcting the corrected moving speeds based on the distribution of the target amount of polishing.

Another aspect of the present invention is to provide a polishing apparatus for polishing a substrate, comprising: a polishing table configured to support a polishing member; a top ring configured to press the substrate against the polishing member; a dresser configured to oscillate on the polishing member to dress the polishing member; a dressing monitoring device configured to adjust a profile of the polishing member; and a surface height measuring device configured to measure a surface height of the polishing member in each of plural oscillation sections which are defined in advance on the polishing member along an oscillation direction of the dresser, the dressing monitoring device being configured to calculate a difference between a current profile obtained from measured values of the surface height and a target profile of the polishing member, and correct moving speeds of the dresser in the plural oscillation sections so as to eliminate the difference.

In a preferred aspect of the present invention, the dressing monitoring device is configured to perform the calculation of the difference between the current profile and the target profile by: calculating cutting rates of the polishing member in the plural oscillation sections from the measured values of the surface height; and calculating differences between the calculated cutting rates and target cutting rates which are set in advance respectively for the plural oscillation sections.

In a preferred aspect of the present invention, the dressing monitoring device is configured to perform the correction of the moving speeds of the dresser by correcting the moving speeds of the dresser on the polishing member in the plural oscillation sections in accordance with the differences between the calculated cutting rates and the target cutting rates.

In a preferred aspect of the present invention, the dressing monitoring device is configured to perform the calculation of the differences between the calculated cutting rates and the target cutting rates by calculating cutting rate ratios which are ratios of the calculated cutting rates to the target cutting rates, and wherein the dressing monitoring device is configured to perform the correction of the moving speeds of the dresser by multiplying the moving speeds of the dresser on the polishing member in the plural oscillation sections by the cutting rate ratios, respectively.

In a preferred aspect of the present invention, the dressing monitoring device is further configured to: calculate a dressing time of the polishing member after the correction of the moving speeds of the dresser; and multiply the corrected moving speeds by an adjustment coefficient for eliminating a difference between the dressing time after the correction and a dressing time of the polishing member before the correction of the moving speeds of the dresser.

In a preferred aspect of the present invention, the adjustment coefficient is a ratio of the dressing time after the correction to the dressing time before the correction.

In a preferred aspect of the present invention, the polishing apparatus further comprises a film thickness measuring device configured to measure a film thickness of the substrate polished by the polishing member, wherein the dressing monitoring device is further configured to correct the corrected moving speeds based on a difference between a residual film thickness profile obtained from measured values of the film thickness and a target film thickness profile.

In a preferred aspect of the present invention, the dressing monitoring device is configured to perform the further correction of the corrected moving speeds by: calculating polishing rates of the substrate in plural zones arrayed in a radial direction of the substrate from the measured values of the film thickness; preparing target polishing rates which are set in advance for the plural zones; calculating cutting rates of the polishing member in the oscillation sections corresponding to the plural zones; calculating correction coefficients from the polishing rates, the target polishing rates, and the cutting rates; and multiplying the corrected moving speeds in the oscillation sections by the correction coefficients, respectively.

In a preferred aspect of the present invention, the dressing monitoring device is further configured to: obtain an initial film thickness profile and a target film thickness profile of the substrate; calculate a distribution of target amount of polishing from a difference between the initial film thickness profile and the target film thickness profile; and further correct the corrected moving speeds based on the distribution of the target amount of polishing.

According to the present invention, the current profile of the polishing member is produced from the measured values of the surface height of the polishing member which has been dressed by the dresser, and the moving speeds of the dresser on the polishing member are corrected based on the difference between the target profile and the current profile. By oscillating the dresser at the moving speeds corrected in this manner, the target profile can be accurately achieved.

DETAILED DESCRIPTION

Figure 1:
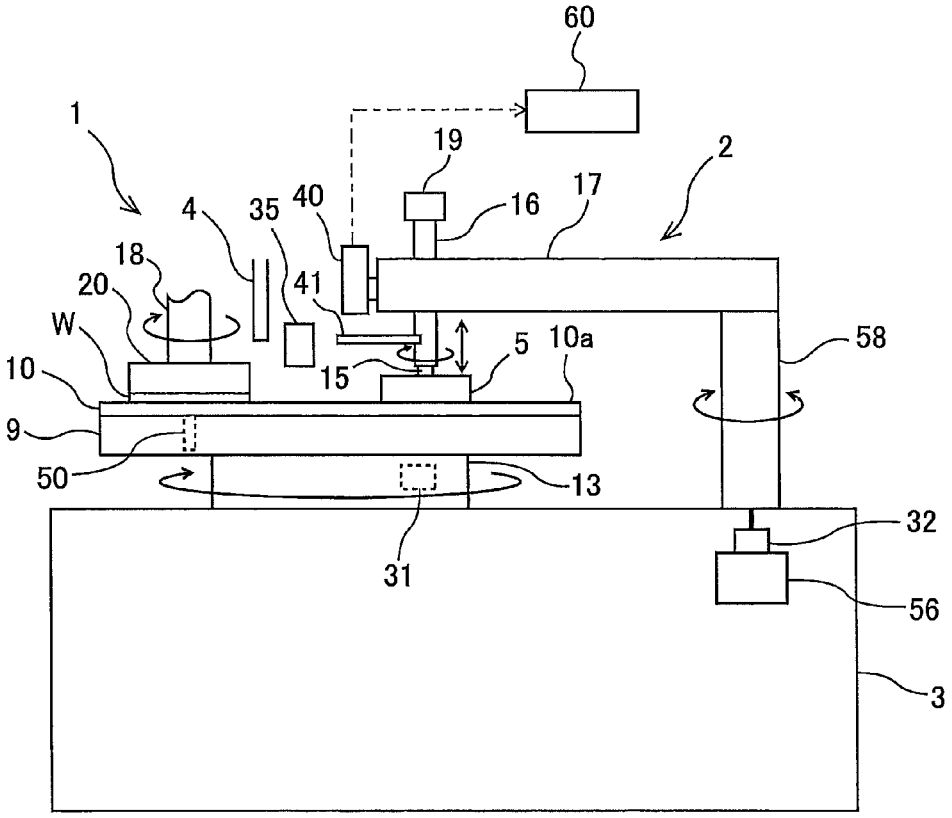
FIG. 1 is a schematic view showing a polishing apparatus for polishing a substrate, such as a wafer.

Embodiments according to the present invention will be explained with reference to the drawings. FIG. 1 is a schematic view showing a polishing apparatus for polishing a substrate, such as a wafer. As shown in FIG. 1, the polishing apparatus includes a polishing table 9 configured to hold a polishing pad (or a polishing member) 10, a polishing unit 1 configured to polish a wafer W, a polishing liquid supply nozzle 4 configured to supply a polishing liquid onto the polishing pad 10, and a dressing unit 2 configured to condition (or dress) the polishing pad 10 which is used to polish the wafer W. The polishing unit 1 and the dressing unit 2 are provided on a base 3.

The polishing unit 1 includes a top ring (or a substrate holder) 20 coupled to a lower end of a top ring shaft 18. The top ring 20 is constructed so as to hold the wafer W on its lower surface by vacuum suction. The top ring shaft 18 is rotated by a motor (not shown in the drawing), and the top ring 20 and the wafer W are rotated together with this rotation of the top ring shaft 18. The top ring shaft 18 is moved vertically relative to the polishing pad 10 by a vertically moving mechanism (constructed, for example, by a servomotor and a ball screw) which is not shown in the drawing.

The polishing table 9 is coupled to a motor 13 which is arranged below the polishing table 9. The polishing table 9 is rotated about its axis by the motor 13. A polishing pad 10 is attached to an upper surface of the polishing table 9. An upper surface of the polishing pad 10 provides a polishing surface 10*a* for polishing the wafer W.

Polishing of the wafer W is performed as follows. The top ring 20 and the polishing table 9 are rotated respectively, and the polishing liquid is supplied onto the polishing pad 10. In this state, the top ring 20, holding the wafer W thereon, is lowered, and further the wafer W is pressed against the polishing surface 10*a* of the polishing pad 10 by a pressurizing mechanism (not shown in the drawing) which is constituted by airbags installed in the top ring 20. The wafer W and the polishing pad 10 are brought into sliding contact with each other in the presence of the polishing liquid, so that the surface of the wafer W is polished and planarized.

The dressing unit 2 includes a dresser 5 which is brought into contact with the polishing surface 10*a* of the polishing pad 10, a dresser shaft 16 coupled to the dresser 5, a pneumatic cylinder 19 provided at an upper end of the dresser shaft 16, and a dresser arm 17 for rotatably supporting the dresser shaft 16. Abrasive grains, such as diamond particles, are attached to a lower surface of the dresser 5. The lower surface of the dresser 5 constitutes a dressing surface for dressing the polishing pad 10.

The dresser shaft 16 and the dresser 5 are configured to be able to move vertically relative to the dresser arm 17. The pneumatic cylinder 19 is a device which applies a dressing load on the polishing pad 10 to the dresser 5. The dressing load can be regulated by an air pressure supplied to the pneumatic cylinder 19.

The dresser arm 17 is constructed so as to pivot on a support shaft 58 by actuation of a motor 56. The dresser shaft 16 is rotated by a motor (not shown in the drawing) installed in the dresser arm 17. Thus, the dresser 5 is rotated about its axis by the rotation of the dresser shaft 16. The pneumatic cylinder 19 presses the dresser 5 against the polishing surface 10*a* of the polishing pad 10 through the dresser shaft 16 at a predetermined load.

Conditioning of the polishing surface 10*a* of the polishing pad 10 is performed as follows. The polishing table 9 and the polishing pad 10 are rotated by the motor 13, while a dressing liquid (e.g., pure water) is supplied from a dressing liquid supply nozzle (not shown in the drawing) onto the polishing surface 10*a* of the polishing pad 10. Further, the dresser 5 is rotated about its axis. The dresser 5 is pressed against the polishing surface 10*a* by the pneumatic cylinder 19 so that the lower surface (the dressing surface) of the dresser 5 is brought into sliding contact with the polishing surface 10*a*. In this state, the dresser arm 17 pivots to oscillate the dresser 5 on the polishing pad 10 in an approximately radial direction of the polishing pad 10. The polishing pad 10 is scraped away by the rotating dresser 5, so that the conditioning of the polishing surface 10*a* is performed.

A pad height sensor (i.e., a surface height measuring device) 40 for measuring a height of the polishing surface 10*a* is secured to the dresser arm 17. Furthermore, a sensor target 41, located opposite to the pad height sensor 40, is secured to the dresser shaft 16. The sensor target 41 vertically moves together with the dresser shaft 16 and the dresser 5, while the pad height sensor 40 is fixed in its position with respect to a vertical direction. The pad height sensor 40 is a displacement sensor, which is configured to measure a displacement of the sensor target 41 to thereby indirectly measure the height of the polishing surface 10*a* (i.e., a thickness of the polishing pad 10). Since the sensor target 41 is coupled to the dresser 5, the pad height sensor 40 can measure the height of the polishing surface 10*a* during conditioning of the polishing pad 10.

The pad height sensor 40 indirectly measures the polishing surface 10*a* from a position of the dresser 5 with respect to the vertical direction when the dresser 5 contacts the polishing surface 10*a*. Therefore, an average of heights of the polishing surface 10*a* that is in contact with the lower surface (the dressing surface) of the dresser 5 is measured by the pad height sensor 40. The pad height sensor 40 may comprise any type of sensors, such as a linear scale sensor, a laser sensor, an ultrasonic sensor, and an eddy current sensor.

The pad height sensor 40 is coupled to a dressing monitoring device 60, and an output signal of the pad height sensor 40 (i.e., a measured value of the height of the polishing surface 10*a*) is sent to the dressing monitoring device 60. The dressing monitoring device 60 has functions to obtain a profile (i.e., a cross-sectional shape of the polishing surface 10*a*) of the polishing pad 10 from measured values of the height of the polishing surface 10*a* and to determine whether the conditioning of the polishing pad 10 is performed properly.

The polishing apparatus includes a table rotary encoder 31 configured to measure a rotation angle of the polishing table 9 and the polishing pad 10, and a dresser rotary encoder 32 configured to measure a pivot angle of the dresser 5. The table rotary encoder 31 and the dresser rotary encoder 32 are absolute encoders which measure an absolute value of an angle. These rotary encoders 31, 32 are coupled to the dressing monitoring device 60, so that the dressing monitoring device 60 can obtain both the rotation angle of the polishing table 9 and the polishing pad 10 and the pivot angle of the dresser 5 when the pad height sensor 40 is measuring the height of the polishing surface 10*a*.

Figure 2:
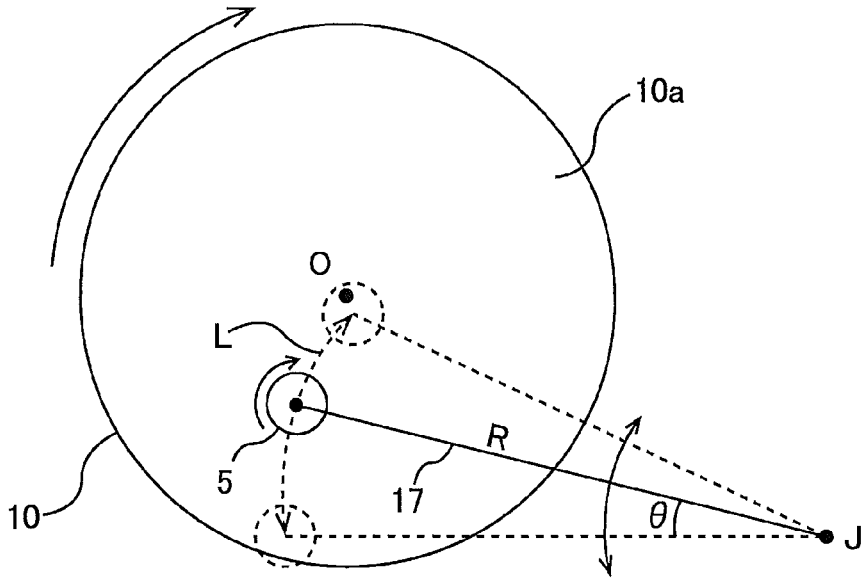
FIG. 2 is a plan view schematically showing a dresser and a polishing pad.

The dresser 5 is coupled to the dresser shaft 16 via a universal joint 15. The dresser shaft 16 is coupled to a motor (not shown in the drawing). The dresser shaft 16 is rotatably supported by the dresser arm 17, which causes the dresser 5 to oscillate in the radial direction of the polishing pad 10 as shown in FIG. 2 while contacting the polishing pad 10. The universal joint 15 is configured to transmit the rotation of the dresser shaft 16 to the dresser 5 while allowing the dresser 5 to tilt. The dresser 5, the universal joint 15, the dresser shaft 16, the dresser arm 17, the rotating device (not shown in the drawing), and other elements constitute the dressing unit 2. The dressing monitoring device 60 for determining a sliding distance of the dresser 5 by simulation is electrically connected to the dressing unit 2. A dedicated or general-purpose computer can be used as the dressing monitoring device 60.

Figure 3A:
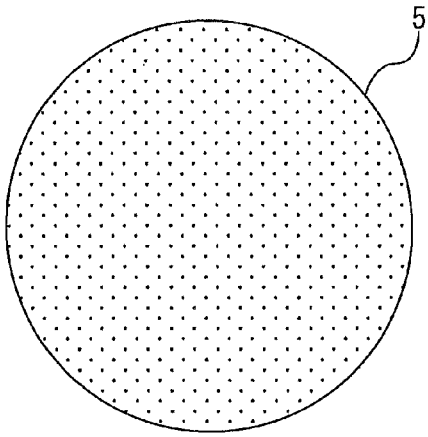
FIG. 3A, FIG. 3B, and FIG. 3C are views each showing an example of dressing surface.
Figure 3B:
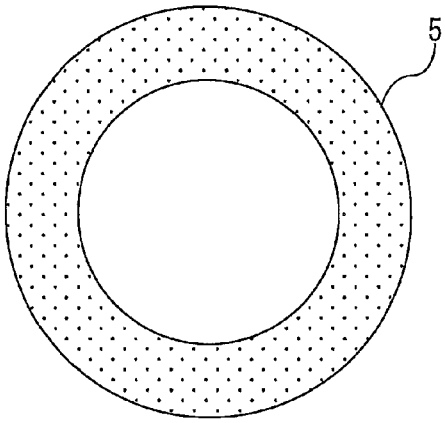
Figure 3C:
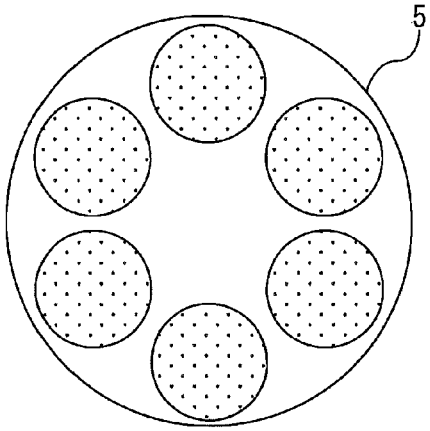

Abrasive grains, such as diamond particles, are fixed to the lower surface of the dresser 5. This portion, to which the abrasive grains are fixed, constitutes the dressing surface that is used to dress the polishing surface of the polishing pad 10. FIG. 3A through FIG. 3C are views each showing an example of the dressing surface. In the example shown in FIG. 3A, the abrasive grains are secured to the lower surface of the dresser 5 in its entirety to provide a circular dressing surface. In the example shown in FIG. 3B, the abrasive grains are secured to a periphery of the lower surface of the dresser 5 to provide an annular dressing surface. In the example shown in FIG. 3C, the abrasive grains are secured to surfaces of plural small-diameter pellets arranged around a center of the dresser 5 at substantially equal intervals to provide plural circular dressing surfaces.

As shown in FIG. 1, when dressing the polishing pad 10, the polishing pad 10 is rotated at a predetermined rotational speed in a direction as indicated by an arrow, and the dresser 5 is also rotated by the rotating device (not shown in the drawing) at a predetermined rotational speed in a direction as indicated by an arrow. In this state, the dressing surface (i.e., the surface with the abrasive grains provided thereon) of the dresser 5 is pressed against the polishing pad 10 at a predetermined dressing load to thereby dress the polishing pad 10. Further, the dresser arm 17 causes the dresser 5 to oscillate on the polishing pad 10 to thereby enable the dresser 5 to dress an area of the polishing pad 10 for use in a polishing process (i.e., a polishing area where the workpiece, such as a wafer, is polished).

Since the dresser 5 is coupled to the dresser shaft 16 via the universal joint 15, even if the dresser shaft 16 is inclined slightly with respect to the surface of the polishing pad 10, the dressing surface of the dresser 5 is kept in contact with the polishing pad 10 appropriately. A pad roughness measuring device 35 for measuring a surface roughness of the polishing pad 10 is provided above the polishing pad 10. A known, non-contact type (such as an optical type) surface roughness measuring device may be used as the pad roughness measuring device 35. This pad roughness measuring device 35 is coupled to the dressing monitoring device 60, so that a measured value of the surface roughness of the polishing pad 10 is sent to the dressing monitoring device 60.

A film thickness sensor (a film thickness measuring device) 50 for measuring a film thickness of the wafer W is provided in the polishing table 9. The film thickness sensor 50 is oriented toward the surface of the wafer W held by the top ring 20. The film thickness sensor 50 is a film thickness measuring device which measures the film thicknesses of the wafer W while moving across the surface of the wafer W with the rotation of the polishing table 9. A non-contact type sensor, such as an eddy current sensor or an optical sensor, may be used as the film thickness sensor 50. A measured value of the film thickness is sent to the dressing monitoring device 60. The dressing monitoring device 60 is constructed so as to produce a film thickness profile of the wafer W (i.e., a film thickness distribution along the radial direction of the wafer W) from measured values of the film thickness.

Next, the oscillation of the dresser 5 will be explained with reference to FIG. 2. The dresser arm 17 pivots around a point J in a clockwise direction and a counterclockwise direction through a predetermined angle. A position of the point J corresponds to a center of the support shaft 58 shown in FIG. 1. This pivoting movement of the dresser arm 17 causes a rotating center of the dresser 5 to oscillate in the radial direction of the polishing pad 10 within a range indicated by an arc L.

Figure 4:
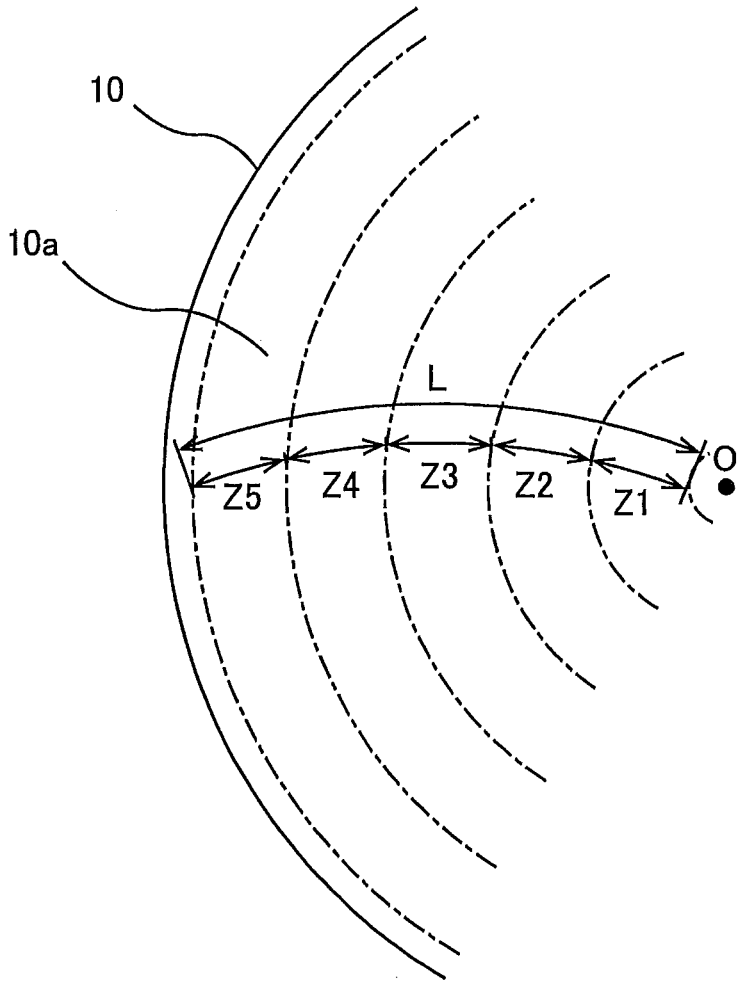
FIG. 4 is a view showing oscillation sections defined on a polishing surface of the polishing pad.

FIG. 4 is an enlarged view of the polishing surface 10*a* of the polishing pad 10. As shown in FIG. 4, an oscillation range (with an oscillation width L) of the dresser 5 is divided into plural (five in FIG. 4) oscillation sections Z1, Z2, Z3, Z4, and Z5. These oscillation sections Z1 through Z5 are imaginary sections which are set in advance on the polishing surface 10*a*, and are arrayed along the oscillating direction of the dresser 5 (i.e., the approximately radial direction of the polishing pad 10). The dresser 5 dresses the polishing pad 10 while moving across these oscillation sections Z1 through Z5. Lengths of these oscillation sections Z1 through Z5 may be the same as or different from each other.

Moving speeds of the dresser 5 when oscillating on the polishing pad 10 are preset for the oscillation sections Z1 through Z5, respectively. The dresser 5 moves across the oscillation sections Z1 through Z5 at the preset moving speeds. A moving-speed distribution of the dresser 5 represents the moving speeds of the dresser 5 in the respective oscillation sections Z1 through Z5.

The moving speed of the dresser 5 is one of determinant factors which determine a cutting rate profile of the polishing pad 10. A cutting rate of the polishing pad 10 represents an amount (or a thickness) of the polishing pad 10 scraped by the dresser 5 per unit time. Typically, the thickness of the polishing pad 10 scraped away differs in the oscillation sections Z1 through Z5. Therefore, values of the cutting rate also vary from oscillation section to oscillation section. However, since a flat pad profile is typically preferred, it may be necessary to adjust the cutting rate such that a difference in the cutting rate between the oscillation sections is small. Increasing the moving speed of the dresser 5 results in a decrease in a staying time of the dresser 5 on the polishing pad 10, i.e., a decrease in the cutting rate of the polishing pad 10. Decreasing the moving speed of the dresser 5 results in an increase in the staying time of the dresser 5 on the polishing pad 10, i.e., an increase in the cutting rate of the polishing pad 10. Therefore, by increasing the moving speed of the dresser 5 in a certain oscillation section, the cutting rate in that oscillation section can be decreased, while by decreasing the moving speed of the dresser 5 in a certain oscillation section, the cutting rate in that oscillation section can be increased. With these operations, the cutting rate profile of the polishing pad in its entirety can be adjusted. The cutting rate used in this method is a value which is obtained by dividing the amount of polishing pad 10 scraped away in a certain oscillation section by "the dressing time of the polishing pad in its entirety", not by "the staying time in each oscillation section".

A target profile of the polishing pad 10 (hereinafter, referred to as a target pad profile) is stored in the dressing monitoring device 60. The target pad profile represents a target height distribution of the polishing surface 10*a* along the radial direction of the polishing pad 10. This target pad profile is input into the dressing monitoring device 60 through an input device (not shown in the drawing), and is stored in a memory (not shown in the drawing) installed therein. The dressing monitoring device 60 produces a current profile of the polishing pad 10 (hereinafter, referred to as a current pad profile) from the measured values of the height of the polishing surface 10*a*, calculates a difference between the current pad profile and the target pad profile, and corrects the moving speeds of the dresser 5 in the oscillation sections Z1 through Z5 based on the difference.

The difference between the current pad profile and the target pad profile is calculated in each of the oscillation sections Z1 through Z5. Therefore, the moving speeds of the dresser 5 are corrected in accordance with differences that are calculated in the oscillation sections Z1 through Z5. More specifically, the moving speeds of the dresser 5 are corrected so as to eliminate the differences. For example, the moving speed of the dresser 5 is decreased in the oscillation section where the measured pad height is higher than a target pad height (a target polishing surface height) that is set for each point of time, while the moving speed of the dresser 5 is increased in the oscillation section where the measured pad height is lower than the target pad height that is set for each point of time. The target pad heights in the respective oscillation sections are obtained from the target pad profile. In this manner, the moving speeds of the dresser 5 are corrected based on the difference between the current pad profile and the target pad profile.

More specific example of correcting the moving speeds of the dresser 5 will be explained below. In the following example, a ratio of a current cutting rate to a target cutting rate is calculated as the difference between the current pad profile and the target pad profile. The dressing monitoring device 60 calculates the cutting rates of the polishing pad 10 in the plural oscillation sections Z1 through Z5 from the measured values of the surface height, calculates ratios of the calculated cutting rates to the target cutting rates (hereinafter, referred to as cutting rate ratios) in the respective oscillation sections Z1 through Z5, and corrects the moving speeds of the dresser 5 when oscillating on the polishing pad 10 by multiplying the current moving speeds of the dresser 5 in the plural oscillation sections Z1 through Z5 by the obtained cutting rate ratios, respectively.

For example, if the target cutting rate in the oscillation section Z1 is 100 [μm/h] and the calculated current cutting rate is 90 [μm/h], the cutting rate ratio in the oscillation section Z1 is 0.9 (=90/100). Therefore, the dressing monitoring device 60 corrects the moving speed of the dresser 5 in the oscillation section Z1 by multiplying the current moving speed in the oscillation section Z1 by 0.9. As result of multiplying the current moving speed by 0.9, the moving speed (the oscillation speed) of the dresser 5 is lowered. Consequently, the staying time of the dresser 5 in the oscillation section Z1 becomes longer, and thus the cutting rate is increased. In this manner, the moving speed of the dresser 5 is corrected. Similarly, the moving speeds of the dresser 5 in other oscillation sections Z2 through Z5 are corrected, so that the moving speed distribution of the dresser 5 in the oscillation range L is adjusted.

The above-described target cutting rates are set in advance respectively for the oscillation sections Z1 through Z5. For example, if it is desired to form a flat polishing surface 10*a*, the target cutting rates may be an average of the measured cutting rates in the polishing surface 10*a* in its entirety, or may be input in advance into the dressing monitoring device 60 from the input device (not shown in the drawing).

Figure 5:
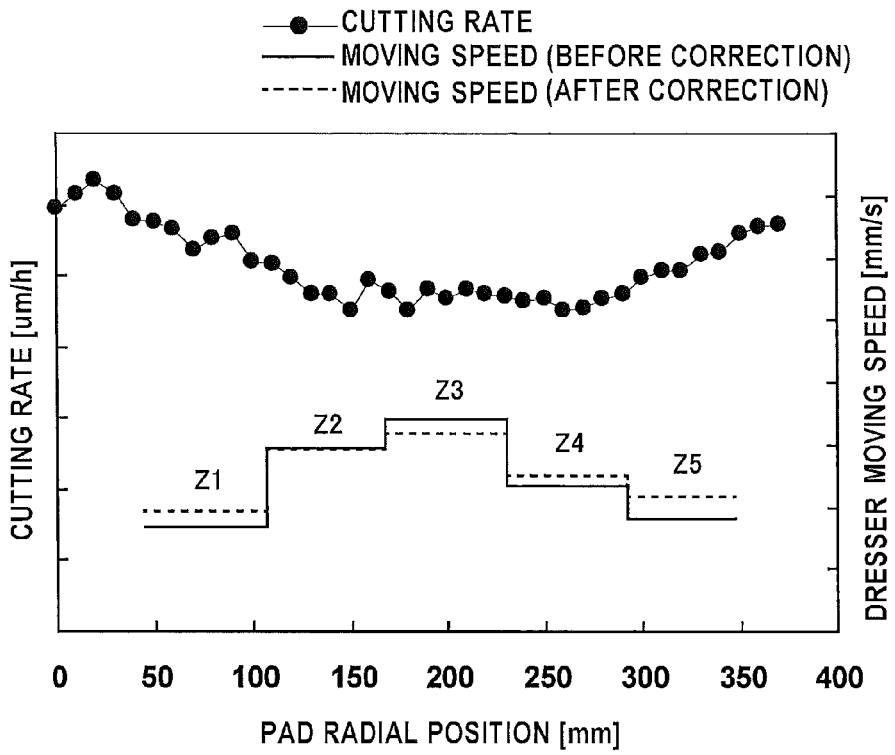
FIG. 5 is a view showing a dresser movement-speed distribution before the correction and a dresser movement-speed distribution after the correction.

FIG. 5 is a view showing a dresser moving-speed distribution before the correction and a dresser moving-speed distribution after the correction. In FIG. 5, a left vertical axis represents the cutting rate of the polishing pad 10, a right vertical axis represents the moving speed of the dresser 5, and a horizontal axis represents a distance in the radial direction on the polishing pad 10. A solid line in the graph indicates the moving speed of the dresser before the correction, and a dotted line in the graph indicates the moving speed of the dresser after the correction.

If the moving speeds of the dresser 5 are corrected as shown in FIG. 5, the dressing time in its entirety may be changed. Such a change in the dressing time may affect other processes, such as a polishing process and a transport of the wafer. Therefore, the dressing monitoring device 60 multiplies the corrected moving speeds in the oscillation sections Z1 through Z5 by an adjustment coefficient so that the dressing time after the correction of the moving speeds of the dresser 5 becomes equal to the dressing time before the correction. For example, if the dressing time before the correction is 10 seconds and the dressing time after the correction is 13 seconds, the dressing monitoring device 60 calculates the adjustment coefficient for eliminating the difference of 3 seconds, (i.e., for adjusting the dressing time after the correction to 10 seconds), and multiplies the corrected moving speeds in the oscillation sections Z1 through Z5 by this adjustment coefficient.

The above-described adjustment coefficient is a ratio of the dressing time after the correction to the dressing time before the correction (hereinafter, referred to as a dressing time ratio). In the above-described example, since the dressing time before the correction is 10 seconds and the dressing time after the correction is 13 seconds, the dressing time ratio is 1.3. Therefore, the corrected moving speeds in the oscillation sections Z1 through Z5 are multiplied by the dressing time ratio of 1.3. The dressing time can be kept constant by the adjustment of the dressing time using such adjustment coefficient regardless of the correction of the moving speeds of the dresser 5.

The dressing of the polishing pad 10 influences a polishing rate (which is also referred to as a removal rate) of the wafer. More specifically, the polishing rate of the wafer becomes higher in a pad region where the dressing has been successfully performed, while the polishing rate of the wafer becomes lower in a pad region where the dressing is inadequately performed. Use of some types of polishing agent may result in a reverse trend. In any case, there is a correlation between the cutting rate of the polishing pad 10 and the polishing rate of the wafer. Therefore, it is possible to adjust the polishing rate of the wafer by adjusting the cutting rate of the polishing pad 10.

The dressing monitoring device 60 may further correct the moving speeds of the dresser 5 based on a difference between a film thickness profile of the polished wafer and a target film thickness profile. An example will be explained below. As shown in FIG. 1, the polishing apparatus includes the film thickness sensor 50. The dressing monitoring device 60 is coupled to the film thickness sensor 50. The dressing monitoring device 60 produces the film thickness profile of the polished wafer (i.e., a residual film thickness profile) from the measured values of the film thickness, and further calculates the polishing rate in each of multiple positions arrayed along the radial direction of the wafer.

Target polishing rates for plural zones arrayed along the radial direction of the wafer are stored in advance in the dressing monitoring device 60. These plural zones are zones defined on the surface of the wafer in advance, and are, for example, a center zone, an intermediate zone, and a peripheral zone of the wafer. The target polishing rates are input in advance into the dressing monitoring device 60 through the input device (not shown in the drawing). The dressing monitoring device 60 may change the target polishing rates while checking actual polishing rates.

The dressing monitoring device 60 calculates correction coefficients from polishing rates R calculated in the plural zones which are arrayed in the radial direction of the wafer, target polishing rates R_tar which are set in advance for the plural zones, and cutting rates C in the oscillation sections corresponding to the plural zones, with use of the following equation.

$$\text{The correction coefficients}=1/(1-K\times(R-R_\text{tar})/C)$$

The dressing monitoring device 60 further corrects the moving speeds by multiplying the moving speeds of the dresser 5 in the above-described oscillation sections by the correction coefficients, respectively. The correction coefficients are calculated with respect to the oscillation sections Z1 through Z5 using the above-described equation. K is a coefficient representing a relationship between the cutting rate and the polishing rate, and is determined in advance through experiments. K may be a constant, or may be expressed as a function of the polishing rate R.

The correction coefficient for the center zone of the wafer is multiplied by the moving speed of the dresser 5 in the oscillation section Z3 corresponding to the center zone of the wafer, the correction coefficient for the intermediate zone of the wafer is multiplied by the moving speeds of the dresser 5 in the oscillation sections Z2 and Z4 corresponding to the intermediate zone of the wafer, and the correction coefficient for the peripheral zone of the wafer is multiplied by the moving speeds of the dresser 5 in the oscillation sections Z1 and Z5 corresponding to the peripheral zone of the wafer. The oscillation sections which correspond to the center zone, the intermediate zone, and the peripheral zone of the wafer are selected in advance from the oscillation sections Z1 through Z5. In this manner, the polishing rate of the wafer can be controlled by adjusting the cutting rate of the polishing pad 10 through the moving speeds of the dresser 5.

Since the residual film thickness profile is obtained after polishing of the wafer, the correction of the moving speeds of the dresser 5 based on the residual film thickness profile is reflected on polishing of a subsequent wafer. The dresser 5 dresses the polishing pad 10 under dressing conditions including the corrected moving speeds, so that the pad profile can approach the target pad profile. The subsequent wafer is polished by the polishing pad 10 that has a pad profile closer to the target pad profile.

The dressing monitoring device 60 may correct the moving speeds of the dresser 5 based on a difference between an initial film thickness profile and a target film thickness profile of the wafer. The target film thickness profile is stored in the dressing monitoring device 60. This target film thickness profile is input in advance into the dressing monitoring device 60 through the input device (not shown in the drawing). The dressing monitoring device 60 calculates a distribution of target amount of polishing from the difference between the initial film thickness profile and the target film thickness profile. The target amount of polishing is a difference between an initial film thickness and a target film thickness in each of the wafer zones, and is obtained by subtracting the target film thickness from the initial film thickness.

The dressing monitoring device 60 corrects the corrected moving speeds of the dresser 5 based on the distribution of the target amount of polishing. More specifically, the moving speed of the dresser 5 is decreased in the oscillation section corresponding to the wafer zone where the target polishing amount is large, while the moving speed of the dresser 5 is increased in the oscillation section corresponding to the wafer zone where the target polishing amount is small. In this manner, the distribution of the polishing amount of the wafer can be controlled by adjusting the cutting rate of the polishing pad 10 through the moving speed of the dresser 5.

Figure 6:
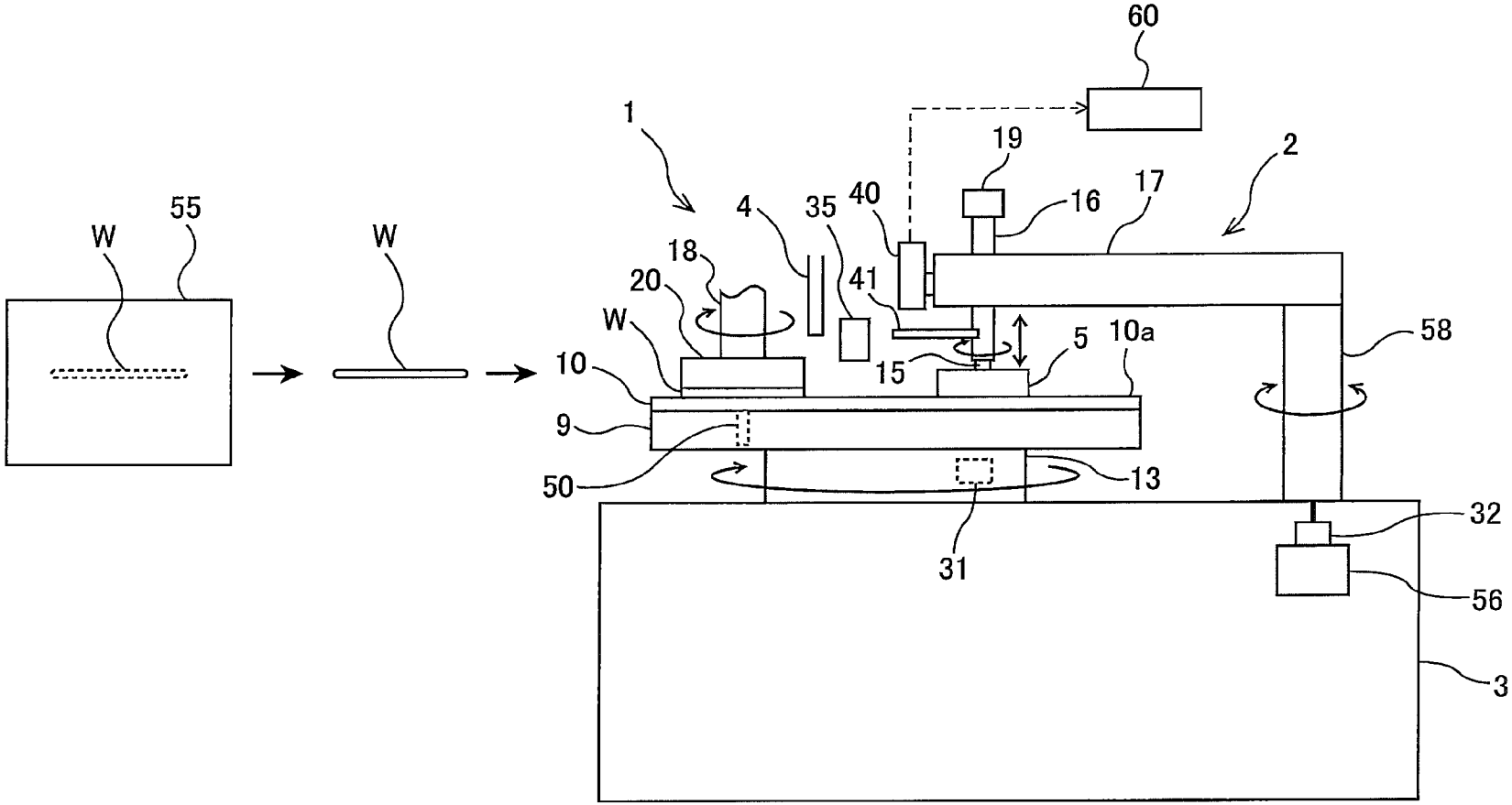
FIG. 6 is a view showing the polishing apparatus including a film thickness measuring device which is provided separately from a polishing table.

Measurement of the initial film thickness is performed by a film thickness measuring device, which is a device provided separately from the film thickness sensor 50, before polishing of the wafer. FIG. 6 is a view showing the polishing apparatus including a film thickness measuring device 55 which is provided separately from the polishing table 9. A non-contact type film thickness measuring device, such as an eddy current sensor or an optical sensor, may be used as the film thickness measuring device 55. The wafer is first transported to the film thickness measuring device 55, where the initial film thickness is measured in multiple positions along the radial direction of the wafer. Measured values of the initial film thickness are sent to the dressing monitoring device 60, which produces the initial film thickness profile from the measured values of the initial film thickness. The dressing monitoring device 60 then corrects the corrected moving speeds of the dresser 5 based on the distribution of the target amount of polishing, as discussed previously.

The dresser 5 dresses the polishing pad 10 under dressing conditions including the corrected moving speeds, whereby the pad profile becomes closer to the target pad profile. The wafer is transported by a transporting mechanism (not shown in the drawing) from the film thickness measuring device 55 to the top ring 20. The wafer is polished on the polishing pad 10, so that a polishing profile that is closer to the target polishing profile can be obtained. The film thickness of the polished wafer may be measured by the film thickness sensor 50, or may be measured by the film thickness measuring device 55. The film thickness measuring device for measuring the initial film thickness may be disposed in the polishing apparatus, or may be disposed outside the polishing apparatus. For example, measurement information obtained by a film thickness measuring device disposed in a processing apparatus (for example, a deposition apparatus) in a preceding stage of the polishing process may be sent to the dressing monitoring device 60.

Figure 7:
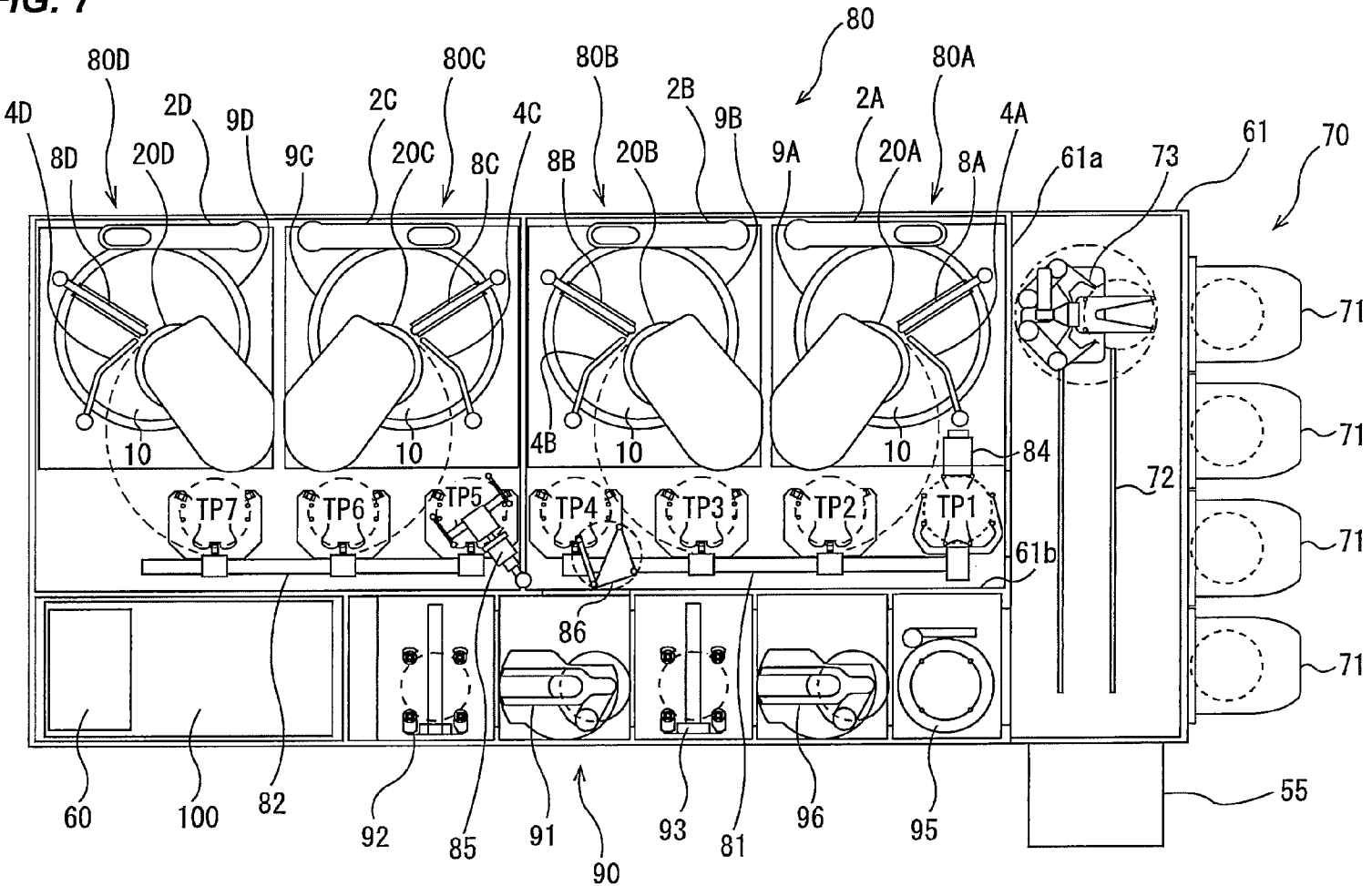
FIG. 7 is a view showing a substrate processing apparatus including the polishing apparatus and the film thickness measuring device.

Next, the detailed configurations of the substrate processing apparatus having the film thickness measuring device 55 and the polishing apparatus shown in FIG. 1 will be described with reference to FIG. 7. The substrate processing apparatus is configured to perform a series of processes of polishing, cleaning, and drying a wafer. As shown in FIG. 7, the substrate processing apparatus has a housing 61 in approximately a rectangular shape. An interior space of the housing 61 is divided by partitions 61*a* and 61*b* into a load-unload section 70, a polishing section 80, and a cleaning section 90. The substrate processing apparatus includes an operation controller 100 configured to control wafer processing operations. The dressing monitoring device 60 is incorporated in the operation controller 100.

The load-unload section 70 has front load sections 71 on which wafer cassettes are placed, respectively. A plurality of wafers (substrates) are stored in each wafer cassette. The load-unload section 70 has a moving mechanism 72 extending along an arrangement direction of the front load sections 71. A transfer robot (a loader) 73 is provided on the moving mechanism 72 so that the transfer robot 73 can move along the arrangement direction of the wafer cassettes. The transfer robot 73 is able to access the wafer cassettes mounted to the front load sections 71 by moving on the moving mechanism 72.

The polishing section 80 is an area where the wafer is polished. This polishing section 80 includes a first polishing apparatus 80A, a second polishing apparatus 80B, a third polishing apparatus 80C, and a fourth polishing apparatus 80D. The first polishing apparatus 80A includes a first polishing table 9A on which a polishing pad 10 having a polishing surface is mounted, a first top ring 20A for holding the wafer and pressing the wafer against the polishing pad 10 on the polishing table 9A so as to polish the wafer, a first polishing liquid supply nozzle 4A for supplying a polishing liquid (e.g., slurry) and a dressing liquid (e.g., pure water) onto the polishing pad 10, a first dressing unit 2A for dressing the polishing surface of the polishing pad 10, and a first atomizer 8A for ejecting a liquid (e.g., pure water) or a mixture of a liquid (e.g., pure water) and a gas (e.g., nitrogen gas) in an atomized state onto the polishing surface.

Similarly, the second polishing apparatus 80B includes a second polishing table 9B on which a polishing pad 10 is mounted, a second top ring 20B, a second polishing liquid supply nozzle 4B, a second dressing unit 2B, and a second atomizer 8B. The third polishing apparatus 80C includes a third polishing table 9C on which a polishing pad 10 is mounted, a third top ring 20C, a third polishing liquid supply nozzle 4C, a third dressing unit 2C, and a third atomizer 8C. The fourth polishing apparatus 80D includes a fourth polishing table 9D on which a polishing pad 10 is mounted, a fourth top ring 20D, a fourth polishing liquid supply nozzle 4D, a fourth dressing unit 2D, and a fourth atomizer 8D.

The first polishing apparatus 80A, the second polishing apparatus 80B, the third polishing apparatus 80C, and the fourth polishing apparatus 80D have the same configuration, each having the same configuration as the polishing apparatus shown in FIG. 1. More specifically, the top rings 20A through 20D, the dressing units 2A through 2D, the polishing tables 9A through 9D, and the polishing liquid supply nozzles 4A through 4D shown in FIG. 7 correspond to the top ring 20, the dressing unit 2, the polishing table 9, and the polishing liquid supply nozzle 4 shown in FIG. 1, respectively. In FIG. 1, the atomizer is omitted.

As shown in FIG. 7, a first linear transporter 81 is arranged adjacent to the first polishing apparatus 80A and the second polishing apparatus 80B. This first linear transporter 81 is configured to transport the wafer between four transfer positions (i.e., a first transfer position TP1, a second transfer position TP2, a third transfer position TP3, and a fourth transfer position TP4). A second linear transporter 82 is arranged adjacent to the third polishing apparatus 80C and the fourth polishing apparatus 80D. This second linear transporter 82 is configured to transport the wafer between three transfer positions (i.e., a fifth transfer position TP5, a sixth transfer position TP6, and a seventh transfer position TP7).

A lifter 84 is provided adjacent to the first transfer position TP1 for receiving the wafer from the transfer robot 73. The wafer is transported from the transfer robot 73 to the first linear transporter 81 via the lifter 84. A shutter (not shown in the drawing) is provided on the partition 61*a* at a position between the lifter 84 and the transfer robot 73. When the wafer is to be transported, this shutter is opened to allow the transfer robot 73 to deliver the wafer to the lifter 84.

The film thickness measuring device 55 is disposed adjacent to the load-unload section 70. The wafer is removed from the wafer cassette by the transfer robot 73, and is transported to the film thickness measuring device 55. In the film thickness measuring device 55, the initial film thickness is measured at plural positions along the radial direction of the wafer. After the initial film thickness is measured, the wafer is transported to the lifter 84 by the transfer robot 73, is further transported from the lifter 84 to the first linear transporter 81, and is transported by the first linear transporter 81 to the polishing apparatus 80A and the polishing apparatus 80B. The top ring 20A of the first polishing apparatus 80A is movable between a position above the polishing table 9A and the second transfer position TP2 by its swing motion. Therefore, transferring of the wafer to and from the top ring 20A is performed at the second transfer position TP2.

Similarly, the top ring 20B of the second polishing apparatus 80B is movable between a position above the polishing table 9B and the third transfer position TP3. Transferring of the wafer to and from the top ring 20B is performed at the third transfer position TP3. The top ring 20C of the third polishing apparatus 80C is movable between a position above the polishing table 9C and the sixth transfer position TP6. Transferring of the wafer to and from the top ring 20C is performed at the sixth transfer position TP6. The top ring 20D of the fourth polishing apparatus 80D is movable between a position above the polishing table 9D and the seventh transfer position TP7. Transferring of the wafer to and from the top ring 20D is performed at the seventh transfer position TP7.

A swing transporter 85 is provided between the first linear transporter 81, the second linear transporter 82, and the cleaning section 90. Transporting of the wafer from the first linear transporter 81 to the second linear transporter 82 is performed by the swing transporter 85. The wafer is transported to the third polishing apparatus 80C and/or the fourth polishing apparatus 80D by the second linear transporter 82.

A temporary placement station 86 for the wafer is disposed beside the swing transporter 85. This temporary placement station 86 is mounted to a frame (not shown in the drawing). As shown in FIG. 7, the temporary placement station 86 is arranged adjacent to the first linear transporter 81 and is located between the first linear transporter 81 and the cleaning section 90. The swing transporter 85 is configured to transport the wafer between the fourth transfer position TP4, the fifth transfer position TP5, and the temporary placement station 86.

The wafer W, placed on the temporary placement station 86, is transported to the cleaning section 90 by a first transfer robot 91 of the cleaning section 90. As shown in FIG. 7, the cleaning section 90 includes a first cleaning module 92 and a second cleaning module 93 for cleaning the polished wafer with a cleaning liquid, and a drying module 95 for drying the cleaned wafer. The first transfer robot 91 is configured to transport the wafer from the temporary placement station 86 to the first cleaning module 92 and further transport the wafer from the first cleaning module 92 to the second cleaning module 93. A second transfer robot 96 is disposed between the second cleaning module 93 and the drying module 95.

This second transfer robot 96 is operable to transport the wafer from the second cleaning module 93 to the drying module 95.

The dried wafer is removed from the drying module 95 by the transfer robot 73 and transported to the film thickness measuring device 55. In the film thickness measuring device 55, the film thickness of the polished wafer is measured at plural positions along the radial direction of the wafer. The measurement is typically performed in the same positions as those in the initial film thickness measurement.

The measured wafer is removed from the film thickness measuring device 55 by the transfer robot 73 and returned to the wafer cassette. In this manner, a series of processes including polishing, cleaning, and drying of the wafer is performed.

In the above-described embodiment, the dresser is swung around the point J of the dresser pivot shaft as shown in FIG. 2. It is noted that the present invention can be applied to an embodiment in which the dresser performs a linear reciprocating motion and an embodiment in which the dresser performs other motions. Furthermore, while in the above-described embodiment the cutting rate is adjusted by adjusting the moving speed of the dresser, the present invention can be applied to an embodiment in which the cutting rate is adjusted by correcting the load or the rotational speed of the dresser. In addition, while in the above-described embodiment the polishing member (i.e., the polishing pad) is rotated as shown in FIG. 1, the present invention can be applied to an embodiment in which the polishing member moves like an endless track.

What is claimed is:

1. A method of adjusting a profile of a polishing member used in a polishing apparatus for a substrate, the method comprising:

dressing the polishing member by oscillating a dresser on the polishing member;

measuring a surface height of the polishing member at each of plural oscillation sections which are defined in advance on the polishing member along an oscillation direction of the dresser;

calculating a difference between a current cutting rate obtained from measured values of the surface height and a target cutting rate of the polishing member; and correcting moving speeds of the dresser in the plural oscillation sections so as to eliminate the difference.

2. The method according to claim 1, wherein calculating the difference between the current cutting rate and the target cutting rate comprises:

calculating cutting rates of the polishing member in the plural oscillation sections from the measured values of the surface height; and calculating differences between the calculated cutting rates and target cutting rates which are set in advance respectively for the plural oscillation sections.

3. The method according to claim 2, wherein correcting the moving speeds of the dresser comprises correcting the moving speeds of the dresser on the polishing member in the plural oscillation sections in accordance with the differences between the calculated cutting rates and the target cutting rates.

4. The method according to claim 2, wherein:

calculating the differences between the calculated cutting rates and the target cutting rates comprises calculating cutting rate ratios which are ratios of the calculated cutting rates to the target cutting rates; and correcting the moving speeds of the dresser comprises multiplying the moving speeds of the dresser on the polishing member in the plural oscillation sections by the cutting rate ratios, respectively.

5. The method according to claim 1, further comprising:

calculating a dressing time of the polishing member after the correction of the moving speeds of the dresser; and multiplying the corrected moving speeds by an adjustment coefficient for eliminating a difference between the dressing time after the correction and a dressing time of the polishing member before the correction of the moving speeds of the dresser.

6. The method according to claim 5, wherein the adjustment coefficient is a ratio of the dressing time after the correction to the dressing time before the correction.

7. The method according to claim 1, further comprising:

measuring a film thickness of the substrate polished by the polishing member; and further correcting the corrected moving speeds based on a difference between a residual film thickness profile obtained from measured values of the film thickness and a target film thickness profile.

8. The method according to claim 7, wherein further correcting the corrected moving speeds comprises:

calculating polishing rates of the substrate in plural zones arrayed in a radial direction of the substrate from the measured values of the film thickness;

preparing target polishing rates which are set in advance for the plural zones;

calculating cutting rates of the polishing member in the oscillation sections corresponding to the plural zones;

calculating correction coefficients from the polishing rates, the target polishing rates, and the cutting rates; and multiplying the corrected moving speeds in the oscillation sections by the correction coefficients, respectively.

9. The method according to claim 7, further comprising:

obtaining an initial film thickness profile and a target film thickness profile of the substrate;

calculating a distribution of target amount of polishing from a difference between the initial film thickness profile and the target film thickness profile; and further correcting the corrected moving speeds based on the distribution of the target amount of polishing.

10. A polishing apparatus for polishing a substrate, comprising:

a polishing table configured to support a polishing member;

a top ring configured to press the substrate against the polishing member;

a dresser configured to oscillate on the polishing member to dress the polishing member;

a dressing monitoring device configured to adjust a cutting rate of the polishing member; and a surface height measuring device configured to measure a surface height of the polishing member in each of plural oscillation sections which are defined in advance on the polishing member along an oscillation direction of the dresser, the dressing monitoring device being configured to calculate a difference between a current cutting rate obtained from measured values of the surface height and a target cutting rate of the polishing member, and correct moving speeds of the dresser in the plural oscillation sections so as to eliminate the difference.

11. The polishing apparatus according to claim 10, wherein the dressing monitoring device is configured to perform the calculation of the difference between the current cutting rate and the target cutting rate by:

calculating cutting rates of the polishing member in the plural oscillation sections from the measured values of the surface height; and calculating differences between the calculated cutting rates and target cutting rates which are set in advance respectively for the plural oscillation sections.

12. The polishing apparatus according to claim 11, wherein the dressing monitoring device is configured to perform the correction of the moving speeds of the dresser by correcting the moving speeds of the dresser on the polishing member in the plural oscillation sections in accordance with the differences between the calculated cutting rates and the target cutting rates.

13. The polishing apparatus according to claim 11, wherein the dressing monitoring device is configured to perform the calculation of the differences between the calculated cutting rates and the target cutting rates by calculating cutting rate ratios which are ratios of the calculated cutting rates to the target cutting rates, and wherein the dressing monitoring device is configured to perform the correction of the moving speeds of the dresser by multiplying the moving speeds of the dresser on the polishing member in the plural oscillation sections by the cutting rate ratios, respectively.

14. The polishing apparatus according to claim 10, wherein the dressing monitoring device is further configured to:

calculate a dressing time of the polishing member after the correction of the moving speeds of the dresser; and multiply the corrected moving speeds by an adjustment coefficient for eliminating a difference between the dressing time after the correction and a dressing time of the polishing member before the correction of the moving speeds of the dresser.

15. The polishing apparatus according to claim 14, wherein the adjustment coefficient is a ratio of the dressing time after the correction to the dressing time before the correction.

16. The polishing apparatus according to claim 10, further comprising a film thickness measuring device configured to measure a film thickness of the substrate polished by the polishing member, wherein the dressing monitoring device is further configured to correct the corrected moving speeds based on a difference between a residual film thickness profile obtained from measured values of the film thickness and a target film thickness profile.

17. The polishing apparatus according to claim 16, wherein the dressing monitoring device is configured to perform the further correction of the corrected moving speeds by:

calculating polishing rates of the substrate in plural zones arrayed in a radial direction of the substrate from the measured values of the film thickness;

preparing target polishing rates which are set in advance for the plural zones;

calculating cutting rates of the polishing member in the oscillation sections corresponding to the plural zones;

calculating correction coefficients from the polishing rates, the target polishing rates, and the cutting rates; and multiplying the corrected moving speeds in the oscillation sections by the correction coefficients, respectively.

18. The polishing apparatus according to claim 16, wherein the dressing monitoring device is further configured to:

obtain an initial film thickness profile and a target film thickness profile of the substrate;

calculate a distribution of target amount of polishing from a difference between the initial film thickness profile and the target film thickness profile; and further correct the corrected moving speeds based on the distribution of the target amount of polishing.

19. The method according to claim 1, wherein:

the current cutting rate is a measurement that represents an amount or a thickness of the polishing member scraped by the dresser per unit time; and the target cutting rate is a predetermined measurement that represents an amount or a thickness of the polishing member scraped by the dresser per unit time.

20. The polishing apparatus according to claim 10, wherein:

the current cutting rate is a measurement that represents an amount or a thickness of the polishing member scraped by the dresser per unit time; and the target cutting rate is a predetermined measurement that represents an amount or a thickness of the polishing member scraped by the dresser per unit time.

* * * * *